US010851604B2

(12) United States Patent
Krüger et al.

(10) Patent No.: US 10,851,604 B2
(45) Date of Patent: Dec. 1, 2020

(54) DOWNHOLE WIRELINE MACHINING TOOL STRING

(71) Applicant: WELLTEC A/S, Allerød (DK)

(72) Inventors: Christian Krüger, Allerød (DK); Sven Karsten Jensen, Allerød (DK)

(73) Assignee: Welltec A/S, Allerød (DK)

( * ) Notice: Subject to any disclaimer, the term of this patent is extended or adjusted under 35 U.S.C. 154(b) by 196 days.

(21) Appl. No.: 15/371,656

(22) Filed: Dec. 7, 2016

(65) Prior Publication Data

US 2017/0159385 A1 Jun. 8, 2017

(30) Foreign Application Priority Data

Dec. 8, 2015 (EP) ..... 15198341
Jul. 7, 2016 (EP) ..... 16178500

(51) Int. Cl.
*E21B 29/00* (2006.01)
*E21B 27/00* (2006.01)
(Continued)

(52) U.S. Cl.
CPC ..... *E21B 29/002* (2013.01); *E21B 27/00* (2013.01); *E21B 29/10* (2013.01); *E21B 37/02* (2013.01)

(58) Field of Classification Search
CPC ..... E21B 29/002; E21B 29/10; E21B 37/02; E21B 29/007; E21B 29/00; E21B 31/002; E21B 27/00; E21B 37/00
See application file for complete search history.

(56) References Cited

U.S. PATENT DOCUMENTS 2,013,348 A * 9/1935 Howard ..... E21B 10/02 175/254
3,110,084 A * 11/1963 Kinzbach ..... B23C 5/2265 408/231
(Continued)

FOREIGN PATENT DOCUMENTS

RU 2 057 895 C1 4/1996
RU 113 535 U1 2/2012
(Continued)

OTHER PUBLICATIONS

Search Report for EP 15198341.8, dated May 27, 2016, 8 pages.
(Continued)

*Primary Examiner* — Nicole Coy
(74) *Attorney, Agent, or Firm* — Nixon & Vanderhye P.C.

(57) ABSTRACT

The present invention relates to a downhole wireline machining tool string for increasing an inner diameter of a well tubular metal structure in a well. The downhole wireline machining tool string has a longitudinal axis and comprises a rotatable tool part comprising a machining tool having a first end part, a second end part, a diameter and a circumference, and a stationary tool part comprising a driving unit configured to rotate the rotatable tool part and powered through the wireline. The machining tool comprises a body having an outer face, and the machining tool further comprising a plurality of inserts, each insert having a length along the longitudinal axis, and the inserts projecting from the outer face of the body and being distributed around the circumference. Furthermore, the present invention relates to a machining tool for increasing an inner diameter of a well tubular metal structure in a well or cutting out a piece, e.g. in a downhole valve.

24 Claims, 11 Drawing Sheets

(51) Int. Cl.
*E21B 29/10* (2006.01)
*E21B 37/02* (2006.01)

(56) References Cited

U.S. PATENT DOCUMENTS 4,084,636 A * 4/1978 Burge ..... E21B 4/02 166/66.5
4,717,290 A 1/1988 Reynolds et al.
5,027,914 A * 7/1991 Wilson ..... E21B 10/26 166/55.6
5,058,666 A * 10/1991 Lynde ..... E21B 10/46 166/55.6
5,074,356 A * 12/1991 Neff ..... E21B 10/26 166/55.7
5,181,564 A * 1/1993 Lindley ..... E21B 29/002 166/55.6
6,378,629 B1 * 4/2002 Baird ..... E21B 7/061 175/107
6,478,088 B1 11/2002 Hansen et al.
8,042,613 B2 * 10/2011 Hallundbaek ..... E21B 10/26 166/297
8,960,329 B2 2/2015 Downton
10,125,553 B2 * 11/2018 Uhlenberg ..... E21B 10/605
2012/0145394 A1 6/2012 Jensen et al.
2013/0153227 A1 6/2013 Laird et al.
2014/0305653 A1 * 10/2014 Lee ..... E21B 29/002 166/311

FOREIGN PATENT DOCUMENTS

RU 124 920 U1 2/2013
RU 131 410 U1 8/2013
RU 2 513 602 C2 4/2014
WO WO 2013/067263 5/2013

OTHER PUBLICATIONS

Office Action of Substantive Examination dated Feb. 28, 2020 in Russian Application No. 2018122849/03(036154), with English translation, 12 pages.

* cited by examiner

DOWNHOLE WIRELINE MACHINING TOOL STRING

This application claims priority to EP Application No. 15198341.8 filed on Dec. 8, 2015 and EP Application No. 16178500.1 filed on Jul. 7, 2016, the entire contents of each of which are hereby incorporated by reference.

FIELD OF THE INVENTION

The present invention relates to a downhole wireline machining tool string for increasing an inner diameter of a well tubular metal structure in a well, the downhole wireline machining tool string having a longitudinal axis and comprising a rotatable tool part comprising a machining tool having a first end part, a second end part, a diameter and a circumference, and a stationary tool part.

BACKGROUND ART

A casing or a liner in a well often has restrictions such as nipples, no-goes or patches, or restrictions caused by scale or cement on the inner surface, and in order to optimise production e.g. by intervening the well by a tool, this restriction needs to be removed or at least decreased in order to increase the inner diameter of the casing. Another possible restriction may be a stuck valve, such as a ball valve or a flapper valve, at least partly closing the well.

Such restrictions may be removed by means of a wireline tool which is quickly run into the well, but the power available downhole to perform the operation is very limited, which reduces the operation methods available for removing or at least reducing the restriction.

SUMMARY OF THE INVENTION

It is an object of the present invention to wholly or partly overcome the above disadvantages and drawbacks of the prior art. More specifically, it is an object to provide an improved downhole wireline tool string which is able to remove a metal nipple in a well receiving less power than 8,000 watt.

The above objects, together with numerous other objects, advantages and features, which will become evident from the below description, are accomplished by a solution in accordance with the present invention by a downhole wireline machining tool string for increasing an inner diameter of a well tubular metal structure in a well, the downhole wireline machining tool string having a longitudinal axis and comprising:

- a rotatable tool part comprising a machining tool having a first end part, a second end part, a diameter and a circumference, and
- a stationary tool part comprising:
  - a driving unit configured to rotate the rotatable tool part and powered through the wireline, wherein the machining tool comprises a body having an outer face, and the machining tool further comprising a plurality of inserts, each insert having a length along the longitudinal axis, and the inserts projecting from the outer face of the body and being distributed around the circumference.

The well tubular metal structure to be machined may be partly or fully restricted, meaning that the inner diameter of the well tubular metal structure may be zero at the restriction. By increasing the inner diameter of the well tubular metal structure, at least part of the restriction is removed.

The restriction may be made of metal, ceramics, rubber, scale, cement or other materials in a well.

The inserts may be fastened directly to the outer face.

Also, the machining tool may be an abrasive machining tool.

Further, the inserts may be abrasive inserts.

Moreover, the inserts may be fastened directly to the outer face without any support/backing, such as a steel support.

The inserts may be embedded particles of tungsten carbide, cubic boron nitride (CBN) and/or diamonds, which particles are embedded in a binder material. In this manner, the inserts may be worn while still being able to machine as new particles will appear, which particles are configured to proceed with the machining.

Furthermore, the particles may have a grain size of 0.1-1.0 mm.

Additionally, the particles may be distributed in the binder material throughout the length, the width and the height of the inserts.

Also, the machining tool may have a bore arranged coincident with a centre axis of the machining tool around which the rotatable tool part rotates.

Further, the bore may be arranged in the body.

Moreover, the inserts may be plate-shaped and project radially from the body.

Furthermore, the body may have longitudinal grooves in which parts of the inserts extend.

In addition, the inserts may be made of tungsten carbide, cubic boron nitride (CBN) or diamonds embedded in a binder material.

Further, the tungsten carbide, cubic boron nitride (CBN) or diamonds may be in the form of particles having a particle size of 0.01-4.00 mm.

Also, the inserts may extend along the longitudinal axis.

Moreover, the inserts may be soldered, glued or welded to the outer face of the body.

In addition, each insert may have a width smaller than a length of the insert.

Additionally, each insert may have a width which is less than 40% of the length.

Further, the inserts may be distributed along the circumference with a mutual distance being at least the width of one insert.

By having a distance between the inserts, the shavings or cuttings from the machining process of increasing the inner diameter are able to pass the outer face of the insert abutting the restriction and leave the machining area. When the inserts comprise embedded particles which are made of tungsten carbide, cubic boron nitride (CBN) or diamonds, the particles released during the machining process are also able to leave the machining area. By machining area is meant the area of the insert having contact with the restriction.

Moreover, magnets may be arranged on the outer face of the body, closer to the first end part than to the second end part.

Also, the inserts may incline towards at least one of the first and second end parts.

Furthermore, the second end part may have a decreasing outer diameter, and at least part of the inserts may extend at least partly along part of the second end part having the decreasing outer diameter.

Moreover, the second end part having a decreasing diameter causes the second end part to be round, inclining or tapering.

The inserts may be arranged in succession along the longitudinal axis.

Also, the machining tool may have a bore extending into the second end part.

Moreover, the bore may be arranged coincident with a centre axis of the machining tool.

The downhole wireline machining tool string may further comprise an anchor section for anchoring the string in the well, or a self-propelling section, such as a downhole tractor, for propelling the string forward in the well.

Furthermore, the inserts may be arranged in at least a first row and a second row extending along the circumference, and the first row and the second row of inserts may be arranged in succession along the longitudinal axis.

The first row of inserts arranged closest to the second end part may have a smaller outer diameter than the second row of inserts arranged closer to the first end part.

Hereby, the inner diameter of the well tubular metal structure can be increased from a first inner diameter to a second inner diameter by the first row of inserts and from the second inner diameter to a third inner diameter by the second row of inserts. By increasing the inner diameter by means of at least two rows of inserts, the resulting torque is substantially reduced, as the removal of the material is performed in at least two steps instead of one.

Furthermore, an outer diameter of the body may be larger opposite the inserts than closer to the first end part.

In addition, the rotatable tool part may rotate less than 300 revolutions per minute (RPM).

Also, the rotatable tool part may rotate less than 200 revolutions per minute (RPM).

Also, the driving unit may be powered by less than 7,000 watt.

Moreover, the rotatable tool part may rotate at a low torque.

Finally, the machining tool may increase the inner diameter by milling away part of a nipple, scale, a sliding sleeve, a whip stock or a valve.

The machining tool may further comprise a fastening element for fastening a machined piece.

Moreover, the body with inserts may be rotatable in relation to the fastening element.

Furthermore, the fastening element may be circumferenting part of the body, the body being rotatable within the fastening element.

Also, the fastening element may comprise a base part and a projecting part, the projecting part being more flexible than the base part.

In addition, the machining tool may further comprise a core drill having a circumferential wall having inserts, said circumferential wall circumferenting the body and being part of the rotatable tool part.

The present invention also relates to a downhole wireline machining tool string for increasing an inner diameter of a well tubular metal structure in a well or cutting out a piece, e.g. in a downhole valve, the downhole wireline machining tool string having a longitudinal axis and comprising:

- a rotatable tool part comprising a machining tool having a first end part, a second end part, a diameter and a circumference, and
- a stationary tool part comprising:
  - a driving unit configured to rotate the rotatable tool part and powered through the wireline, wherein the machining tool comprises a body having an outer face and a fastening element for fastening a machined piece.

Moreover, the body may be rotatable within or around the fastening element.

Additionally, the fastening element may be arranged in a recess within the body.

In this way, the fastening element projects from the inner face of the body into the bore.

Further, the fastening element may comprise a base part and a projecting part, the projecting part being more flexible than the base part.

Also, the machining tool may further comprise a core drill having a circumferential wall with inserts, said circumferential wall circumferenting the body and being part of the rotatable tool part.

The present invention also relates to a machining tool for increasing an inner diameter of a well tubular metal structure in a well or cutting out a piece, e.g. in a downhole valve, comprising:

- a body,
- an insert forming a drill bit,
- a fastening element circumferenting the body, and
- a core drill having a circumferential wall with inserts, said circumferential wall circumferenting the body.

Moreover, the fastening element may be arranged within an internal recess in the circumferential wall.

Furthermore, the body may be rotatable within the fastening element.

Additionally, the fastening element may comprise a base part and a projecting part, the projecting part being more flexible than the base part.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
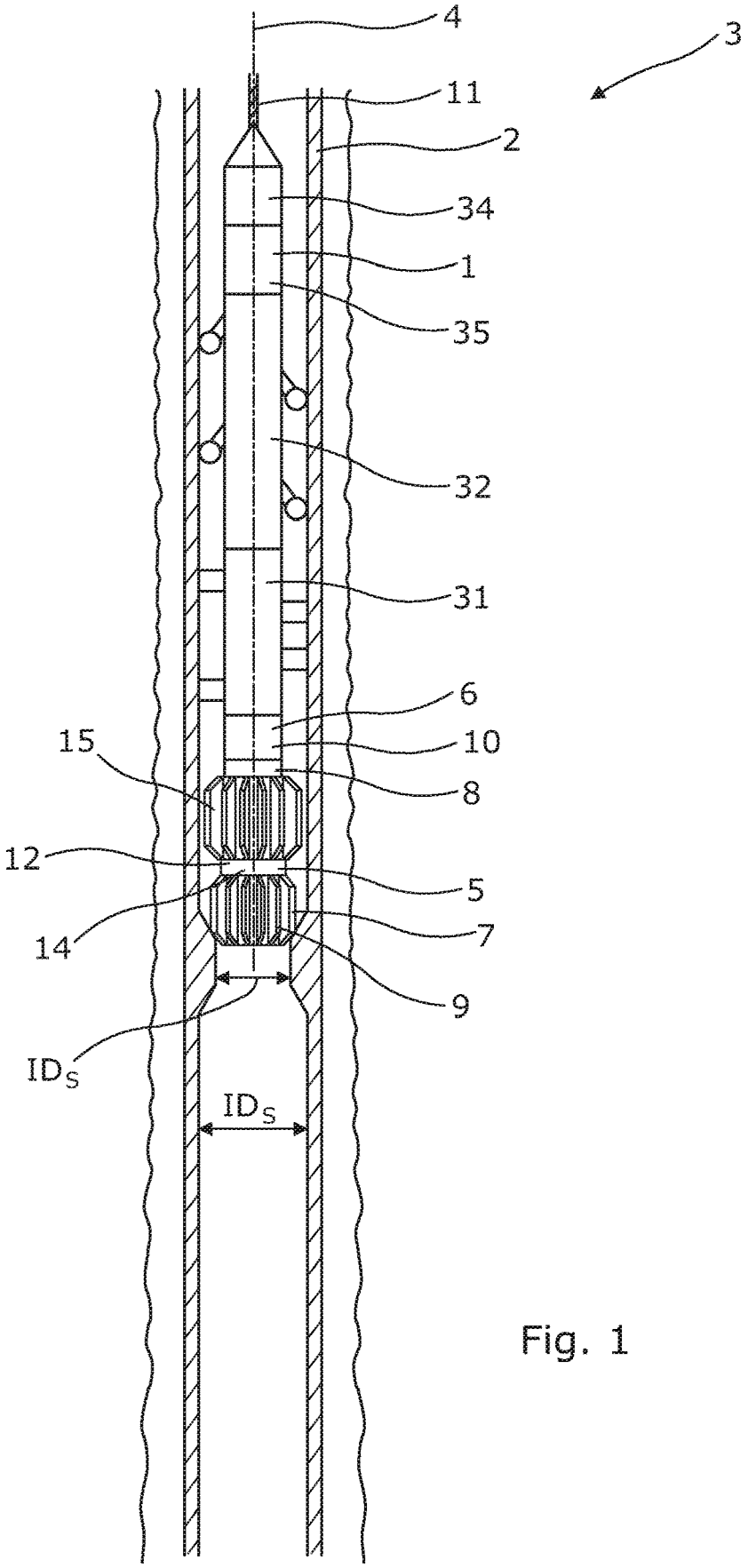
FIG. 1 shows a downhole wireline machining tool string in a well.
Figure 2:
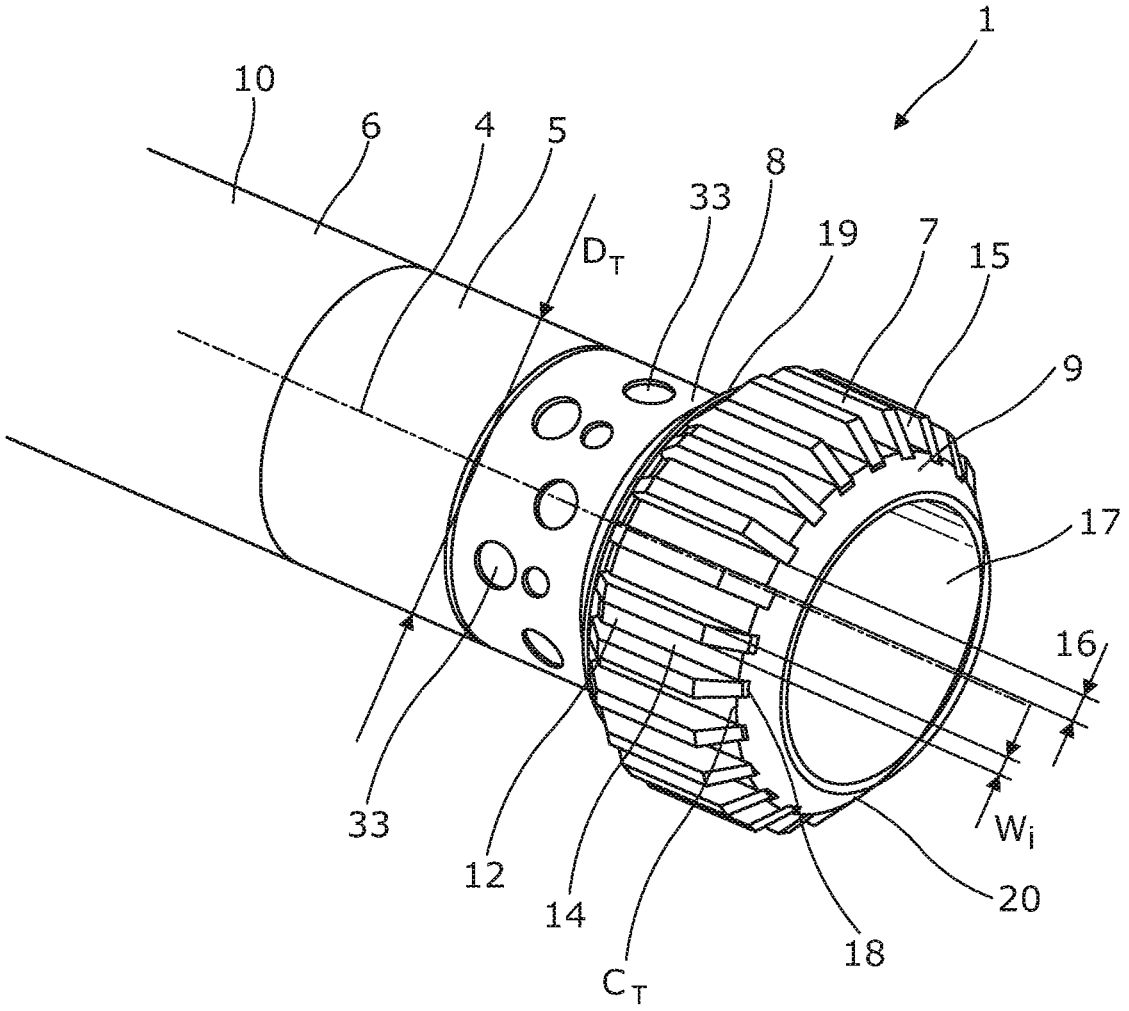
FIG. 2 shows part of a downhole wireline machining tool string in perspective.

FIG. 1 shows a downhole wireline machining tool string 1 for increasing an inner diameter $ID_s$ of a casing or a well tubular metal structure 2 in a well 3. The downhole wireline machining tool string 1 has a longitudinal axis 4 along the extension of the well 3 and comprises a rotatable tool part 5 and a stationary tool part 6. The stationary tool part 6 is arranged closest to a top of the well 3. The rotatable tool part 5 comprises a machining tool 7 having a first end part 8 arranged closest to stationary tool part 6, and a second end part 9 which is arranged by the restriction to be at least partly removed. As shown in FIG. 2, the machining tool 7 has a diameter DT and a circumference CT. The machining tool 7 increases the inner diameter $ID_s$ of the well tubular metal structure by machining, such as by milling away part of a nipple, scale, a sliding sleeve, a whip stock or a valve in order to at least partly remove the restriction.

The stationary tool part 6 of FIG. 1 comprises a driving unit 10, such as an electrical motor, which is configured to rotate the rotatable tool part 5 and is powered through a wireline 11. The machining tool 7 comprises a body 12 having an outer face 14 and a plurality of inserts 15. Each insert 15 has a length L (shown in FIG. 3) along the longitudinal axis 4, and the inserts 15 project from the outer face 14 of the body 12.

Figure 3:
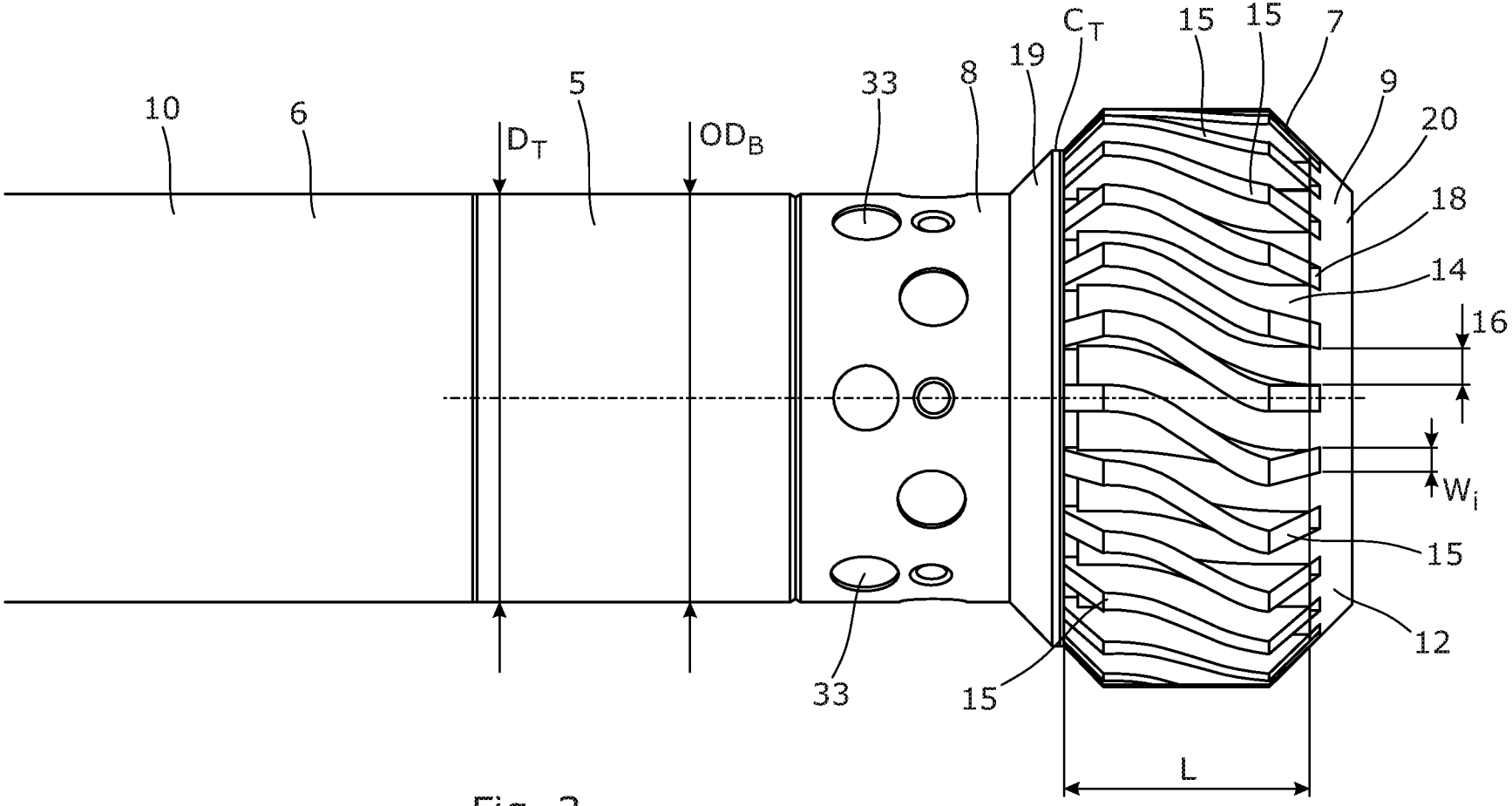
FIG. 3 shows a side view of the downhole wireline machining tool string of FIG. 2.

The inserts 15 are distributed around the circumference CT with a mutual distance 16 between them, as shown in FIGS. 2 and 3. By having a mutual distance between the inserts, fluid is allowed to flow past and along the inserts and thus flush and cool the inserts, thereby increasing the service life of the inserts. Furthermore, the shavings or cuttings released during the machining process are able to pass the outer face of the insert abutting the restriction and leave the machining area. When the inserts comprise embedded particles made of tungsten carbide, cubic boron nitride (CBN) or diamonds, the particles released during the machining process are also able to leave the machining area.

By machining area is meant the area of the insert having contact with the restriction, and along the longitudinal axis 4. The machining area or contact area is less than 60% of the total area of the restriction and preferably less than 50% of the total area of the restriction. In other words, if the tool had contact with the restriction along the whole circumference of the restriction when seen in a cross-sectional view perpendicular to the longitudinal axis, contact with the whole circumference is 100%.

As shown in FIGS. 2 and 3, the inserts 15 are plate-shaped and project radially from the outer face of the body. Each insert 15 is arranged in a groove 18 in the outer face of the body 12 and is fastened to the body, e.g. by means of soldering. The heat may be applied from within the bore of the machining tool. The inserts 15 thus extend from the grooves 18 and project radially outwards away from the outer face 14 of the body 12. The inserts 15 extend along the longitudinal axis so that the length L of the inserts extends along the longitudinal axis 4. Each insert 15 has a width $W_i$ which is less than 40% of the length L of the insert, preferably less than 30% of the length L of the insert, more preferably less than 20% of the length L of the insert, and even more preferably less than 15% of the length L of the insert. The inserts 15 are distributed along the circumference CT, arranged with a mutual distance of at least the width $W_i$ of one insert.

In FIG. 3, the inserts have a curvature and an even thickness along their length. When having a curvature, the inserts function as blades of a turbine and thus lead or shovel the shadings or cuttings away from the machining area.

Figure 4:
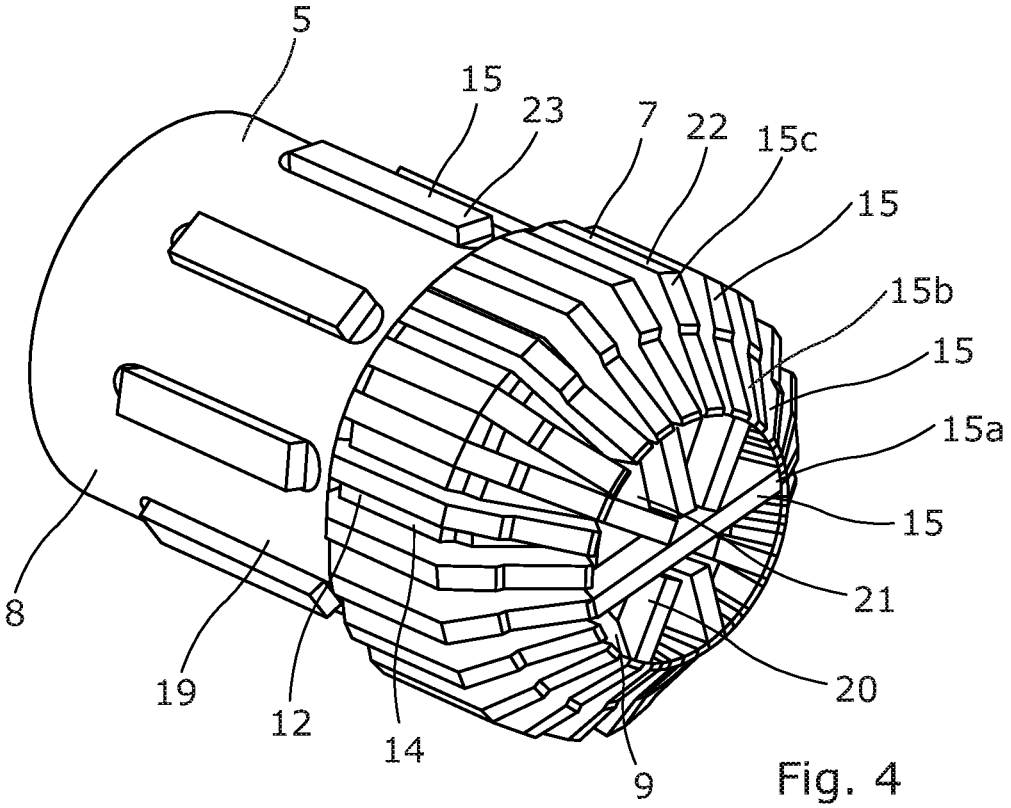
FIG. 4 shows a perspective view of part of another downhole wireline machining tool string having inserts at an end of the machining tool.

In FIG. 2, the machining tool 7 has a bore 17 extending into the second end part 9. By having the bore 17, the area of the machining tool 7 engaging the restriction in order to perform the machining operation, such as by milling or grinding, is substantially reduced, which requires substantially less power than a machining tool 7 having inserts 15 all the way around the front of the tool, as shown in FIG. 4. The bore 17 has a centre axis arranged coincidentally with the centre axis and thus the longitudinal axis 4 of the machining tool 7.

As shown in FIG. 3, the machining tool 7 has a first tool end 19 closest to the stationary tool part 6 and a second tool end 20 closest to the second end part 9, and the inserts 15 incline towards the second tool end 20, thereby enabling the inserts to engage the restriction and centralise the machining tool 7. As can be seen, the inserts 15 also incline towards the first tool end 19, which ensures that the inserts do not have any sharp edges which may easily be broken off. The body 12 of the machining tool 7 has magnets 33 arranged on the outer face 14 of the body 12 so that shavings from the machining process adhere to the magnets 33 and are in this way collected and brought up to surface together with the tool string when the tool string is retracted from the well. The outer diameter ODs of the body is larger opposite the inserts 15 than closer to the first end part 8, and the magnets 33 are arranged in the part of the body having the smaller outer diameter.

In FIG. 4, the second end part 9 of the machining tool 7 has a decreasing outer diameter due to the body tapering, and at least part of the inserts 15 extends partly along part of the second end part 9 having the decreasing outer diameter. By the second end part 9 having a decreasing diameter is meant that the second end part is round, inclining or tapering and some of the inserts 15 cover part of the round, tapering or inclining end part. The rotatable tool part 5 has inserts 15 arranged in succession along the longitudinal axis so that the second end part 9 is partly covered with inserts in prolongation of each other along the longitudinal extension. Inserts 15 are arranged at the centre of the second tool end 20 of the second end part 9, extending from an end face 21 of the second tool end 20, and further inserts are arranged abutting these centre inserts 15, 15*a* and as a prolongation of the centre inserts at the inclining face of the second end part 9. Other inserts 15, 15*c* are arranged in prolongation of the inclining inserts 15, 15*b*, projecting radially from the outer face 14 of the body 12.

Figure 6:
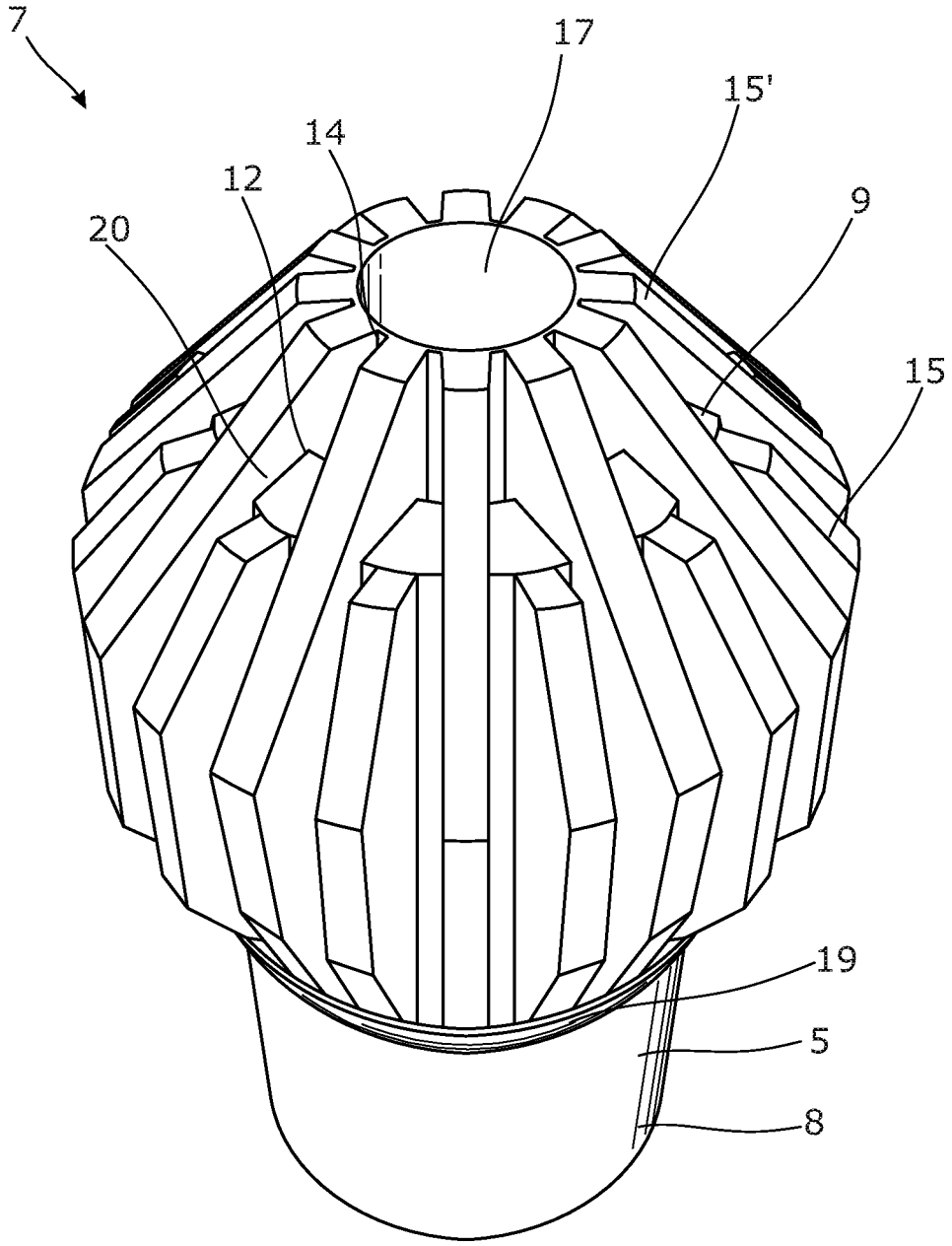
FIG. 6 shows a perspective view of part of yet another downhole wireline machining tool string having inserts at an end of the machining tool and a bore.

In FIG. 6, the machining tool 7 has a bore 17 and first inserts 15, 15' projecting radially from the body 12, and also extending along the inclining surface of the second end part 9. The bore is a centre bore. Thus, when the machining tool 7 machines around a machined piece which then enters the bore, no force is spent on grinding the machined piece, only on grinding a circular groove into the restriction to separate the machined piece. In this way, the restriction can be removed by using only a small amount of force and with a low RPM. The force is very limited when operating on wireline several kilometres down the well and thus, by making such a bore, the restriction, so that flow is re-established, can be performed.

The inserts 15 of FIG. 4 are arranged in a first row 22 and a second row 23, each row extending along the circumference CT (shown in FIG. 8), and the first row 22 and the second row 23 of inserts are arranged in succession along the longitudinal axis 4. The second row 23 of inserts 15 acts as a back-up for the first row 22 of inserts, and the inserts of the first row 22 are arranged in recesses 24.

Figure 5:
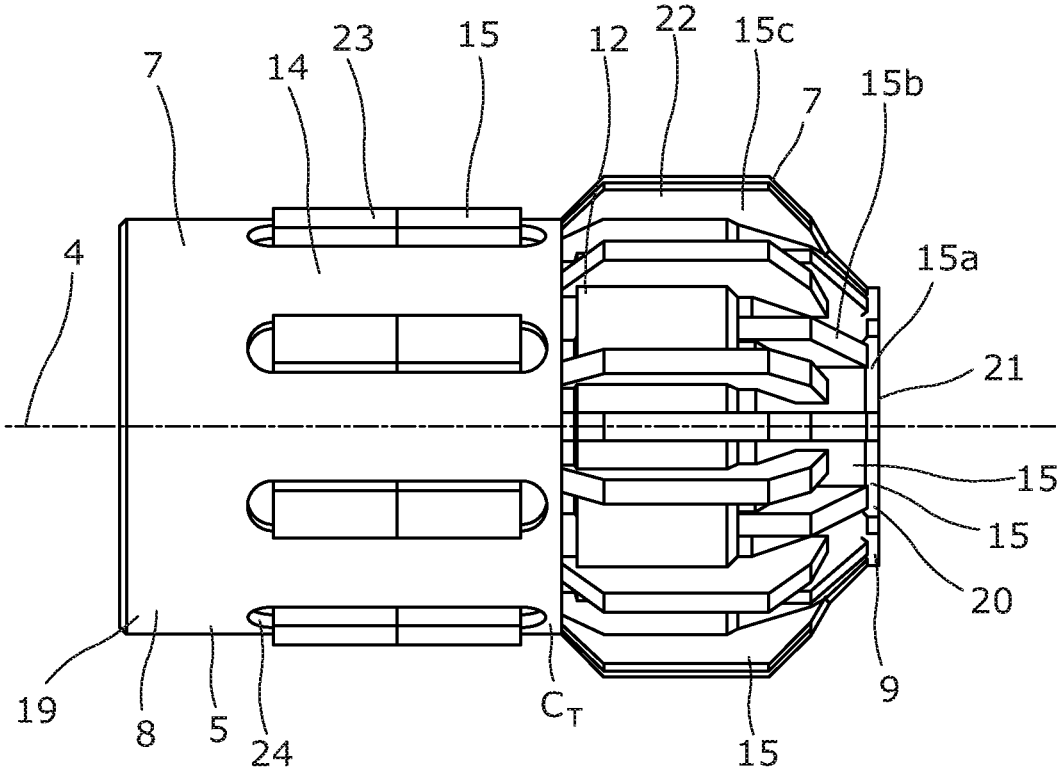
FIG. 5 shows a side view of another downhole wireline machining tool string of FIG. 4.

When seen from the side of the machining tool as shown in FIG. 5, the inserts may be arranged with different lengths and in an overlapping manner, and the inserts 15*b* arranged closest to the second end part 9 have a smaller radial extension than the inserts 15*c* arranged closest to the first part 8. The inserts 15*c* are L-shaped so as to overlap the inserts 15*b* also in the radial direction so that when the inserts 15*b* have machined the restriction from its initial and first inner diameter to a second inner diameter, the inserts 15*c* can take over the machining process to machine and increase the inner diameter of the restriction even further.

The inserts 15 may be made of tungsten carbide, cubic boron nitride (CBN) or diamonds embedded in a binder material, and the tungsten carbide, cubic boron nitride (CBN) or diamonds may be in the form of particles having a particle size of 0.01-2.00 mm. The particles are thus embedded in the binder material. By having smaller bits or particles of tungsten carbide, cubic boron nitride (CBN) or diamonds embedded in a binder material, new bits or particles of tungsten carbide, cubic boron nitride (CBN) or diamonds are always ready to take over when the first part of the insert is worn down, and then, new bits of tungsten carbide, cubic boron nitride (CBN) or diamonds will appear to continue the machining process. Thus, the inserts can be used over a longer period of time, as the inserts function over their entire extension, and machining tools having these inserts are therefore better able to decrease the thickness of the casing from one inner diameter to a second larger inner diameter than known tools. Each insert may thus have particles which are distributed in the binder material throughout the length, the width and the height of the insert. The inserts are abrasive meaning they are able to abrade material off a restriction and thus grind part of the restriction.

Figure 12:
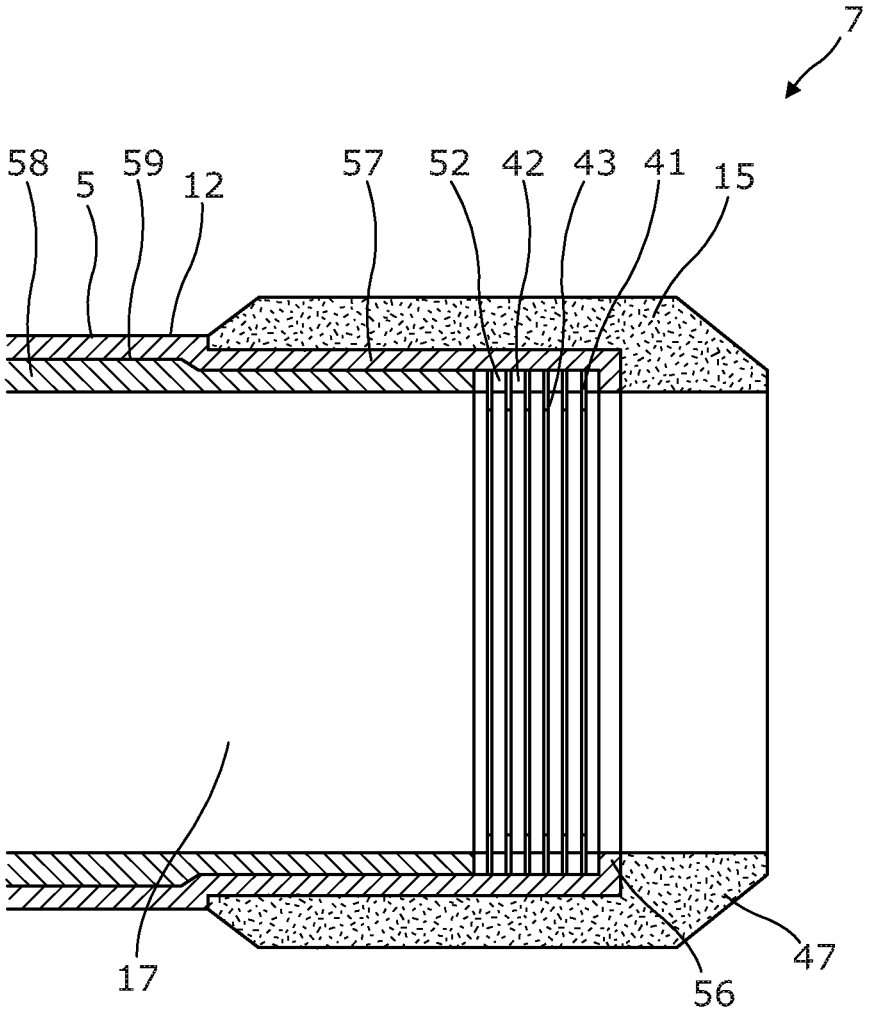
FIG. 12 shows a cross-sectional view of yet another machining tool having a fastening element internally of the machining tool for fastening of a machined piece.

As can be seen in FIGS. 6 and 12, the inserts 15, 15' are fastened directly to the outer face 14 of the body 12 of the rotating part and the inserts are thus fastened directly to the outer face without any support/backing, such as a steel support. This enables that the inserts may be worn down more than 50% and still be able to machine the restriction by abrasive machining. Thus, the machining tool may be an abrasive machining tool.

Figure 7:
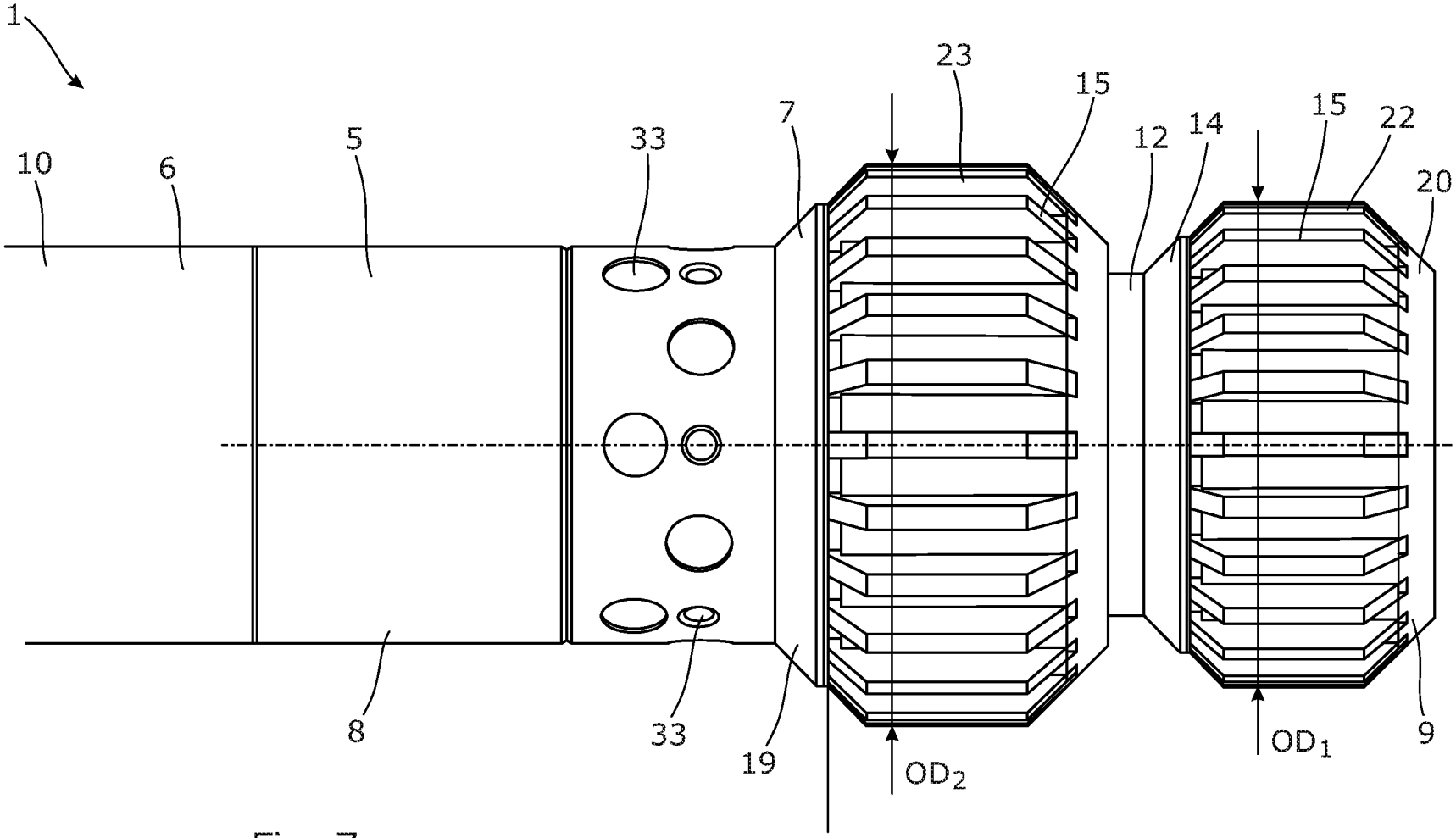
FIG. 7 shows a side view of yet another downhole wireline machining tool string having rows of inserts and thus machining in two steps in one run.

In FIG. 7, the inserts 15 are arranged in at least a first 22 row and a second row 23 extending along the circumference, and the first and second rows of inserts are arranged in succession along the longitudinal axis. The first row 22 of inserts 15 arranged closest to the second end part 9 has a smaller outer diameter $OD_1$ than the second row 23 of inserts arranged closer to the first end part 8. The inner diameter of the well tubular metal structure can thereby be increased from a first inner diameter to a second inner diameter by the first row 22 of inserts 15, and from the second inner diameter to a third inner diameter by the second row 23 of inserts. By increasing the inner diameter $ID_s$ by means of at least two rows 23, 23 of inserts 15, the resulting torque and thus the power required are substantially reduced as the material to be removed is machined in at least two steps instead of one.

Figure 8:
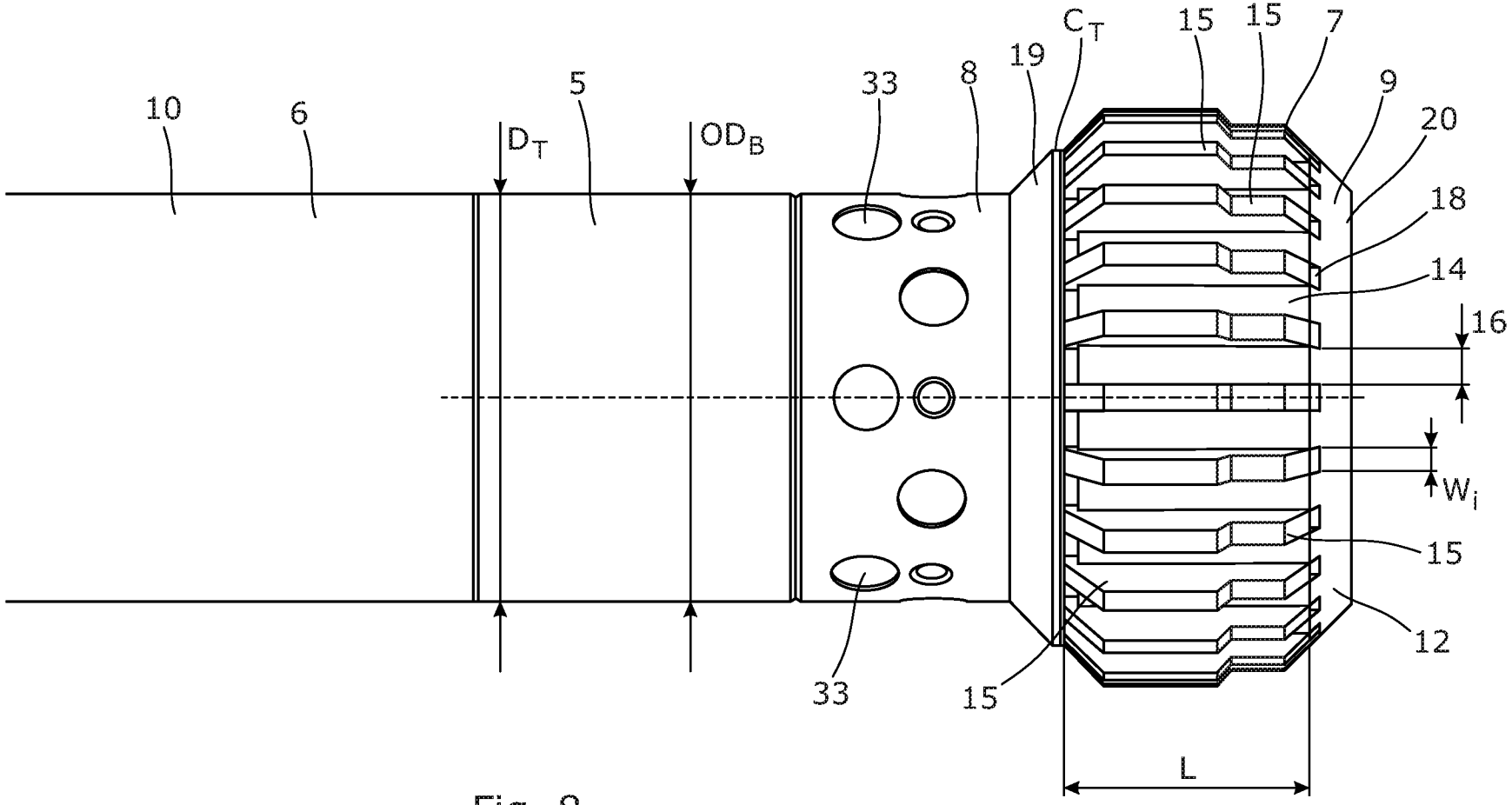
FIG. 8 shows a perspective view of part of yet another downhole wireline machining tool string.

In FIG. 8, each insert has a varying radial extension so that a first part of the insert closest to the second end part 9 of the machining tool has a smaller radial extension than a second end part of the insert closest to the first part 8. The machining tool thus has a smaller outer diameter opposite the part of the inserts having a smaller radial extension, since each insert has an indentation so that the first part of the inserts contact the restriction and machine it from a first initial diameter to a second inner diameter and the second end part of the inserts machine the restriction from the second inner diameter to its final inner diameter.

In another embodiment, the inserts may be plate-shaped, have a varying thickness and be cone-shaped. The inserts may have a varying thickness in the radial direction so that the thickness of the inserts is greater closer to the centre of the machining tool or the thickness may vary along the longitudinal extension.

As can be seen in FIG. 1, the downhole wireline machining tool string 1 further comprises an anchor section 31 for anchoring the string in the well 3, and a self-propelling section 32, such as a downhole tractor, for propelling the string forward in the well. By having either the anchor section 31 or the self-propelling section 32, the tool string 1 is anchored further up the well tubular metal structure 2, which means that all the force is transferred to the machining operation. The anchor section 31 or the self-propelling section 32 comprises a power unit 34, such as an electrical motor, which receives power from the wireline 11. The power unit 34 drives a pump unit 35 driving the anchor section 31 and/or the self-propelling section 32. The anchor section 31 and the self-propelling section 32 may have both a power unit 34 and a pump unit 35. The tool string 1 may furthermore comprise one or more pressure compensators.

Figure 9:
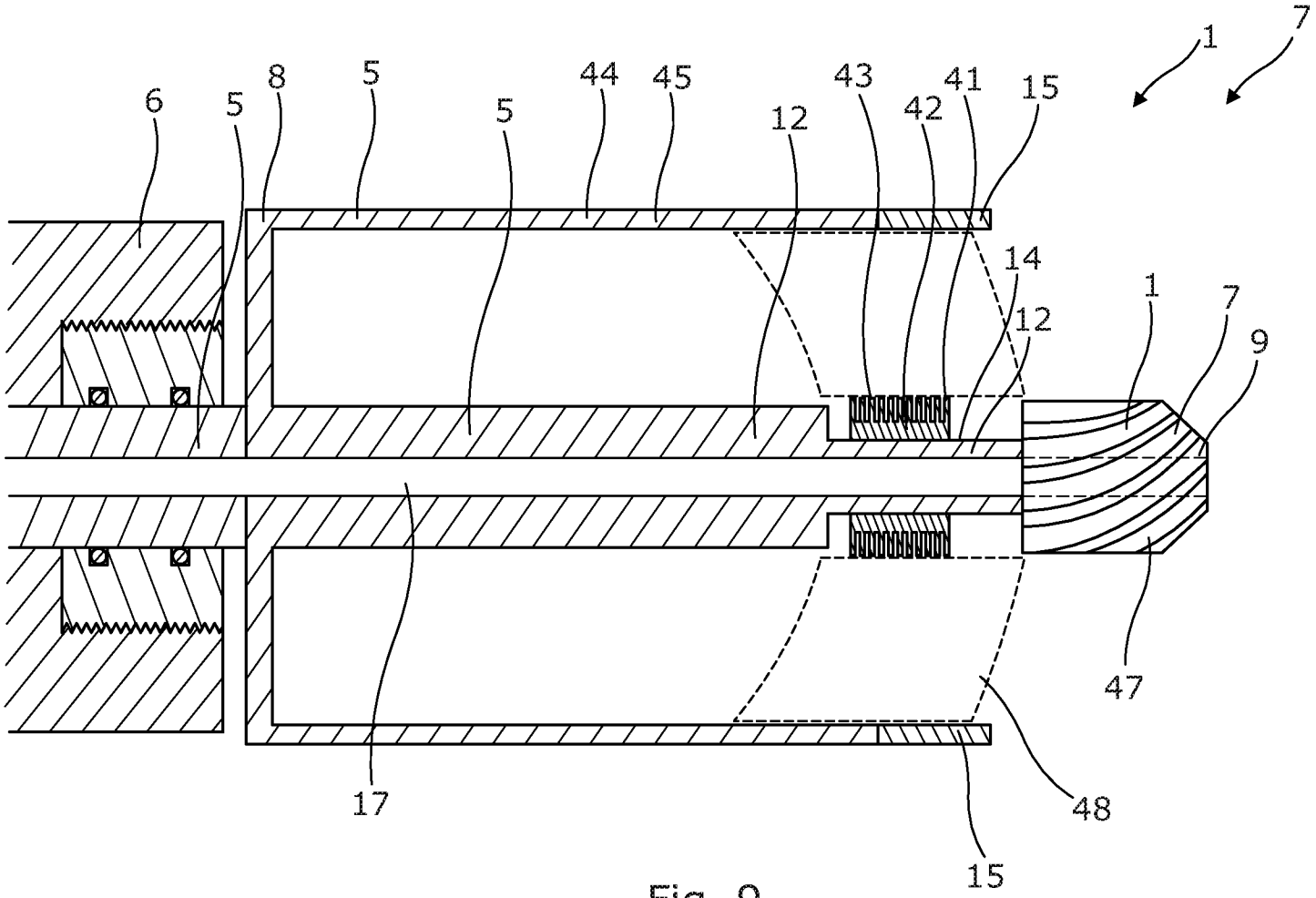
FIG. 9 shows a partly cross-sectional view of part of another downhole wireline machining tool string having a fastening element.

FIG. 9 shows a downhole wireline machining tool string 1 for cutting out a piece, e.g. in a downhole valve. The downhole wireline machining tool string comprises a rotatable tool part 5 comprising a machining tool 7 which has a first end part 8, a second end part 9, and a stationary tool part 6 comprising a driving unit (not shown) configured to rotate the rotatable tool part and powered through a wireline. The machining tool 7 comprises a body 12 ending in a drill bit 47 and having an outer face 14. The machining tool 7 further comprises a fastening element 41 for fastening a machined piece 48, e.g. part of a downhole valve, such as a ball-shaped valve. The fastening element 41 is circumferenting part of the body 12 and the body 12 is rotatable within the fastening element 41 and thus the fastening means is like a union.

The fastening element 41 comprises a base part 42 and projecting parts 43, and the projecting parts are more flexible than the base part so that when the drill bit 47 of the machining tool 7 has drilled through the machined piece 48, the fastening element 41 is able to be squeezed into the drilled hole in the piece 48, and thus the piece is fastened to the machining tool without the fastening element 41 rotating along with the rotating part 5. The body 12 of the machining tool 7 rotates within the fastening element 41 during the machining process, and the fastening element 41, when contacting the piece, does not rotate in relation to the piece and is thus not worn. If the fastening element was to rotate along with the rotating part of the machining tool, the projecting parts 43 would be worn down, and this would cause the outer diameter of the fastening element to be slightly smaller than the inner diameter of the hole in the piece, and the fastening element would thus not be able to fasten the piece within the machining tool 7 and bring the piece to surface along with the machining tool.

As shown in FIG. 9, the machining tool further comprises a core drill 44 having a circumferential wall 45 with inserts 15 and circumferenting the body 12 and being part of the rotatable tool part 5 for providing a circumferenting cut in e.g. a valve almost simultaneously with the drill bit machining a hole the same piece.

Figure 10:
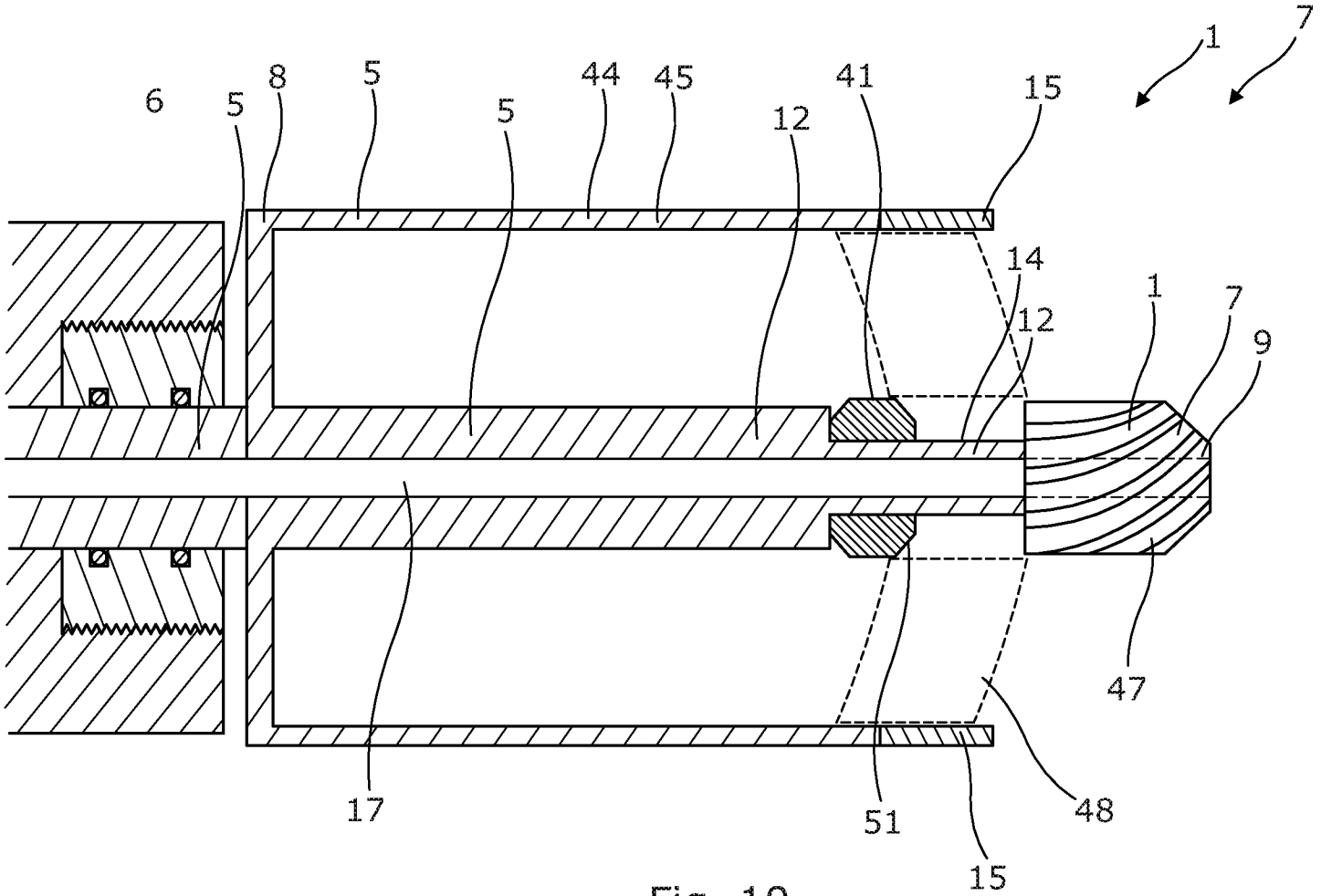
FIG. 10 shows a partly cross-sectional view of another machining tool having a fastening element.
Figure 11:
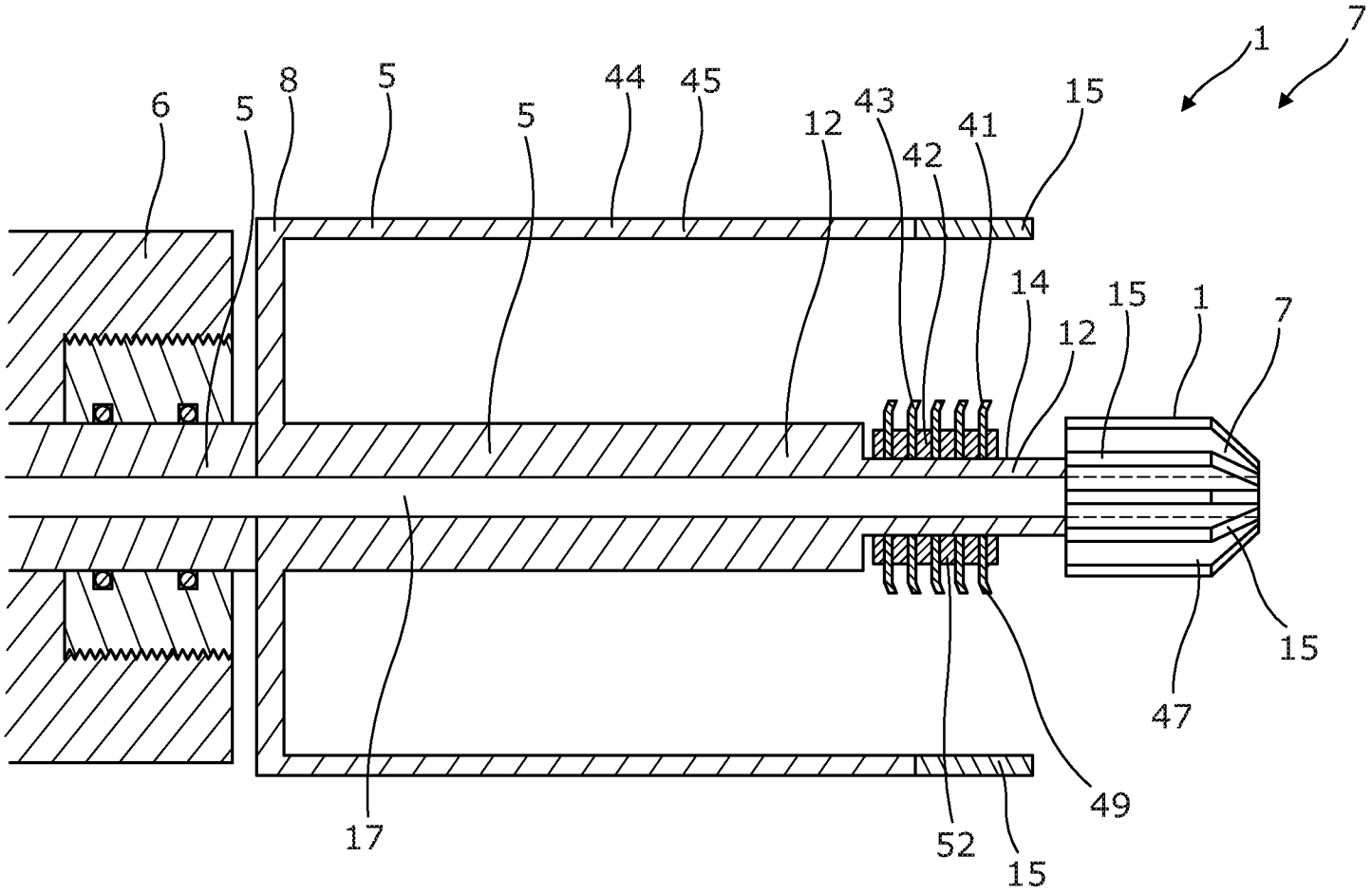
FIG. 11 shows a partly cross-sectional view of yet another machining tool having a fastening element.

The projecting parts 43 are flexible and hence able to bend when being forced into the hole just drilled by the drill bit. The projecting parts 43 may have any shape suitable for fastening the piece being cut. The fastening element 41 may also be cone-shaped, as shown in FIG. 10, so that the piece 48 is pressed onto the inclined surface 51 of the fastening element 41 and thereby fastened. The projecting parts 43 may be wires radially projecting from the base part or, as shown in FIG. 11, discs with radially extending arms 49 which are bent to form the projecting parts 43. Distance elements 52 forming the base part 42 are mounted between the discs, said distance elements thus circumferenting the body 12.

The drill bit may be constituted by inserts 15 as shown in FIG. 6, so that the fastening element 41 is arranged around part of the body as shown in FIG. 11.

In FIG. 12, the machining tool has an internal fastening element 41 for fastening the machined piece so that the machined piece bends the projecting parts 43 while being milled out by the drill bit 47. Once the machined piece is milled out and released from the component from which it was previously attached to, the projecting parts 43 press towards the piece and maintain the piece inside the machining tool. The fastening element 41 has projecting parts 43 which are thus flexible and hence able to bend. The projecting parts 43 are ring-shaped and spaced apart by distance elements 52 forming the base parts 42. The projecting parts 43 and the distance elements 52 abut a flange 56 of the first body part 57 of the body 12 and a second body part 58 is threadingly (by means of the thread 59) connected to the first body part pressing the projecting parts 43 and the distance elements 52 towards the flange, but does not fasten the projecting parts 43 and the distance elements 52 as they are still able to rotate freely in relation to the body 12 so that they are not worn down when the rotatable tool part 5 rotates the drill bit for milling out the piece. The fastening element 41 is thus arranged in the bore 17 and in the event that the machining tool is used to mill out several pieces, e.g. mill through a first ball resulting in a first machined piece and mill through a second ball further down the well resulting in a second machined piece, the first machined piece is pressed further into the bore 17 by the second machined piece while milling out the second piece. The machining tool having a long bore is thus capable of milling out several balls in one run and the machined pieces are stacked in the bore and the last machined piece is held by the fastening element 41, closing the bore and maintaining the other machined pieces in the bore while retracting the machining tool from the well.

The rotatable tool part rotates at a low torque and rotates less 300 revolutions per minute (RPM). The driving unit receives less than 1,000 Volts or 7,000 watt due to a loss of power in the long wireline when performing an operation several kilometres down the well.

A stroking tool may be used to provide weight on a bit, i.e. weight on the machining tool. The stroking tool is a tool providing an axial force along the longitudinal extension. The stroking tool comprises an electrical motor for driving a pump. The pump pumps fluid into a piston housing in order to move a piston acting therein. The piston is arranged on a stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

If the well is filled with gas, the downhole wireline machining tool string may comprise a fluid delivery unit for delivering fluid to the machining area.

By a casing or well tubular metal structure 2 is meant any kind of pipe, tubing, tubular, liner, string etc. used downhole in relation to oil or natural gas production.

In the event that the tool is not submergible all the way into the well tubular metal structure, a downhole tractor can be used to push the tool all the way into position in the well. The downhole tractor may have projectable arms having wheels, wherein the wheels contact the inner surface of the well tubular metal structure for propelling the tractor and the tool forward in the well tubular metal structure. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole wireline machining tool string for increasing an inner diameter of a well tubular metal structure from within the well tubular structure in a radial direction outwards in a well, the downhole wireline machining tool string having a longitudinal axis and comprising:

a rotatable tool part comprising a machining tool having a first end part, a second end part, a diameter and a circumference, and a stationary tool part comprising:

a wireline, and a driving unit configured to rotate the rotatable tool part and electrically powered through the wireline, wherein the machining tool comprises a body having an outer face, and a plurality of machining inserts configured to engage an inner surface of the well tubular metal structure, the machining inserts being fastened to the outer face and extending radially outward beyond the outer face, each machining insert having a length along the longitudinal axis, and the machining inserts being spaced from one another and distributed around the circumference, each of the machining inserts having an axial machining surface and a radial machining surface so as to be able to machine the inner surface of the well tubular structure whilst leaving the remainder of the well tubular structure intact, wherein the machining tool has a bore arranged coincident with a centre axis of the machining tool around which the rotatable tool part rotates, the bore extending into the second end part and having a bore inlet located at a distal end of the second end part, at the front of the tool string, and wherein the machining tool is configured to allow for the bore inlet to receive a machined piece machined by the machining inserts.

2. A downhole wireline machining tool string according to claim 1, wherein the machining inserts are fastened directly to the outer face.

3. A downhole wireline machining tool string according to claim 1, wherein the machining tool is an abrasive machining tool.

4. A downhole wireline machining tool string according to claim 1, wherein the machining inserts are abrasive inserts.

5. A downhole wireline machining tool string according to claim 1, wherein the inserts machining are fastened directly to the outer face without any support/backing.

6. A downhole wireline machining tool string according to claim 1, wherein each machining insert has a width which is less than 40% of the length.

7. A downhole wireline machining tool string according to claim 1, wherein the machining inserts are distributed along the circumference with a mutual distance being at least the width of one insert.

8. A downhole wireline machining tool string according to claim 1, wherein the machining inserts incline towards at least one of the first and second end parts.

9. A downhole wireline machining tool string according to claim 1, wherein the second end part has a decreasing outer diameter, and at least part of the machining inserts extends at least partly along part of the second end part having the decreasing outer diameter.

10. A downhole wireline machining tool string according to claim 1, wherein the machining inserts are arranged in at least a first row and a second row extending along the circumference, and the first row and the second row of machining inserts are arranged in succession along the longitudinal axis.

11. A downhole wireline machining tool string according to claim 1, wherein the rotatable tool part rotates less than 300 revolutions per minute (RPM).

12. A downhole wireline machining tool string according to claim 1, wherein the driving unit is powered by less than 7,000 watt.

13. A downhole wireline machining tool string according to claim 1, wherein the machining tool further comprises a fastener configured to fasten a machined piece, the body with machining inserts being rotatable in relation to the fastener.

14. A downhole wireline machining tool string according to claim 13, wherein the body is rotatable within or around the fastener.

15. A downhole wireline machining tool string according to claim 13, wherein the fastener comprises a base part and a projecting part, the projecting part being more flexible than the base part.

16. A downhole wireline machining tool according to claim 1, wherein the bore inlet is located forward of the machining inserts.

17. A downhole wireline machining tool string according to claim 1, wherein the radial machining surface is wider than the axial machining surface, and the axial machining surface is located between the bore inlet and the radial machining surface.

18. A downhole wireline machining tool string according to claim 17, wherein the axial machining surface comprises an inclined surface having a diameter that decreases towards the bore inlet.

19. A downhole wireline machining tool string for increasing an inner diameter of a well tubular metal structure in a well or cutting out a piece, the downhole wireline machining tool string having a longitudinal axis and comprising:

a rotatable tool part comprising a machining tool having a first end part, a second end part with a drill bit, a diameter and a circumference, and a stationary tool part comprising:

a wireline, and a driving unit configured to rotate the rotatable tool part and electrically powered through the wireline, wherein the machining tool comprises a body having an outer face and a fastener configured to fasten a machined piece, the fastener being configured to resiliently flex to engage an inside diameter of the machined piece drilled by the drill bit, at which point the fastener is non-rotatably fixed to the inside diameter of the machined piece whilst the rotatable part continues to rotate relative to the fastener, and wherein the machining tool has a bore arranged coincident with a centre axis of the machining tool around which the rotatable tool part rotates, the bore having a bore inlet located at the front of the tool string and extending into the second end part.

20. A downhole wireline machining tool string according to claim 19, wherein the machining tool further comprises a core drill having a circumferential wall with inserts, said circumferential wall circumferenting the body and being part of the rotatable tool part.

21. A machining tool for increasing an inner diameter of a well tubular metal structure in a well, comprising:

a body, a drill bit, a fastener circumferenting the body, a core drill having a circumferential wall with inserts, said circumferential wall circumferenting the body, and a wireline to electrically power rotation of the drill bit, wherein the machining tool includes a leading end structured to engage a restriction extending from or formed as part of the inner diameter of the well tubular structure, the machining tool including a bore inlet extending from the front of the tool and into the leading end to reduce engagement between the leading end and the restriction, the bore inlet being adapted to receive a machined piece of the restriction during machining operation, and wherein the fastener is configured to engage an inside diameter of the machined piece, at which point the fastener is non-rotatably fixed to the inside diameter of the machined piece whilst the drill bit continues to rotate relative to the fastener.

22. A machining tool according to claim 21, wherein the body being rotatable within or around the fastener.

23. A machining tool according to claim 21, wherein the inserts are fastened to extend in circumferential alignment with the circumferential wall of the core drill.

24. A machining tool according to claim 21, wherein the fastener ceases to rotate with the drill bit once the fastener engages an inside surface of the machined piece.

* * * * *